United States Patent [19]

Patuzzi et al.

[11] 3,966,180

[45] June 29, 1976

[54] CONVERTER WITH A CONVERTER HOOD

[75] Inventors: Alexander Patuzzi; Manfred Eysn; Peter Moser, all of Linz, Austria

[73] Assignee: Vereinigte Osterreichische Eisen- und Stahlwerke-Alpine Montan Aktiengesellschaft, Linz, Austria

[22] Filed: Sept. 2, 1975

[21] Appl. No.: 609,678

[30] Foreign Application Priority Data

Sept. 12, 1974 Austria ..... 7408/74

[52] U.S. Cl. ..... 266/158; 266/241

[51] Int. Cl.[2] ..... C21C 5/40

[58] Field of Search ..... 266/34 R, 35, 36 P, 266/36 H, 158, 241

[56] References Cited

UNITED STATES PATENTS 3,817,504 6/1974 Vonnemann ..... 266/35

*Primary Examiner*—Roy Lake
*Assistant Examiner*—Paul A. Bell
*Attorney, Agent, or Firm*—Burns, Doane, Swecker & Mathis

[57] ABSTRACT

A converter with a converter hood provided with a plurality of cooling channels, wherein always one single reflux tube is allocated to a plurality of cooling channels and connects them with an upper collector conduit section and the lower distributor conduit section following thereupon; the cooling channels have smaller cross-sections than the reflux tube allocated thereto, and thus the converter hood is provided with an uneven surface.

3 Claims, 2 Drawing Figures

CONVERTER WITH A CONVERTER HOOD

Figure 1:
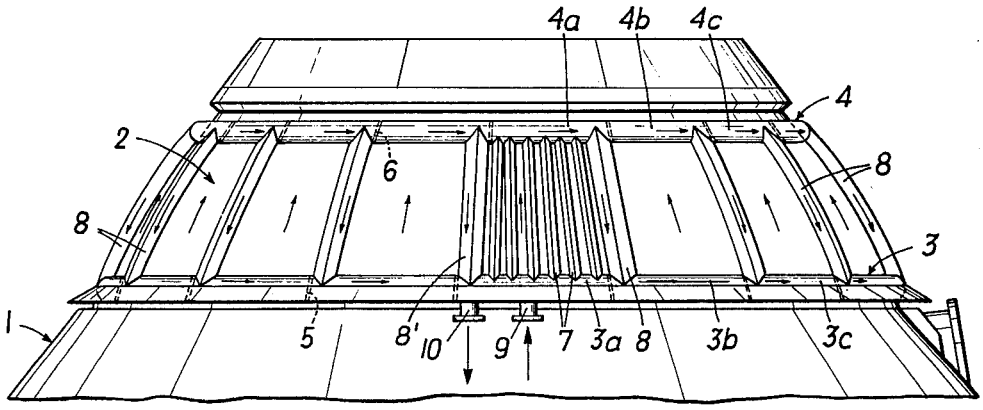

When metallurgical vessels are used, it is necessary to protect parts subjected to high thermal wear from detrimental heat influences by cooling means. In oxygen top blowing converters it is necessary to cool the so-called converter hood, i.e. a part of the converter-jacket above the carrying trunnion to the converter mouth.

The invention relates to a converter with a converter hood, at whose periphery a plurality of cooling channels extending in the generating lines of the hood area and being passed by cooling water is arranged, which channels are connected to distributor and collector conduit sections, respectively, extending horizontally around the periphery of the converter hood, wherein these sections are connected to supply and drain conduits for the coolant extending through one or both carrying trunnions.

A converter cooling of this kind is known from German Auslegeschrift 2,204,199, wherein at the periphery of the converter hood a plurality of cooling channels is provided between the lower and the upper edge of the hood and adjacent one another, which cooling channels are arranged in groups, half of which are allocated to a plurality of upper distributors or collectors, respectively, and to lower distributors or collectors, respectively, which are offset by half the number of channels. The cooling channels and the distributors or collectors, respectively, can be formed as corner irons or half-tube shaped open sections which are welded to the converter-jacket.

This known water cooling, however, does not meet all the demands, insofar as there is the difficulty that the coolant used for the cooling has to pass the same heating area when it moves in upward direction to the converter mouth as well as when it moves downward to the converter middle part. Therefore it is possible that any steam bubbles that could occur when the converter boils over and which have the tendency to rise, are in counterflow relative to the cooling water in individual sections. If both flows balance each other, which is very easily possible, then an uncooled area is created which is subjected to over-heating. This can lead to a rupturing of welding seams between the cooling channels and the converter jacket, which may lead to a contact between water and molten slag and cause explosions.

A further disadvantage may arise when due to differing flow conditions in the individual cooling channels, heating to differing degrees occurs, so that due to the occuring layer flow, zones of various water temperatures are created. Thus it is possible that, due to the above described flow conditions, the temperatures of flow layers passing various cooling channels one after another, rise so much that steam forms.

The invention aims at preventing the above described disadvantages and difficulties and has as its object to create a converter hood cooling system, in which the coolant is better exploited and a uniform flow rate of the coolant without the formation of steam is guaranteed.

In a converter of the above described kind this object is achieved in that always one single reflux tube is allocated to a plurality or group, respectively, of cooling channels leading the coolant from the bottom to the top, i.e. in direction to the converter mouth, which reflux tube connects an upper collector conduit section with the subsequent lower distributor conduit section.

Thus the real or predominant cooling effect occurs only in those areas, in which the coolant flows in direction to the converter mouth, which corresponds to the natural circulation of the coolant in a heat exchanger of this kind, whereas the coolant in the reflux tube is less heated up due to the essentially smaller heating area, and thus there is no danger of the formation of steam in the counterflow.

A further decisive advantage of the system of the invention consists in that, even when steam bubbles form, due to a possible strong thermal wear, they tend to rise without impairing the cooling effect, as it would be the case with steam bubbles occurring in the counterflow. Thus an overwear and damage to the cooling channels is prevented. If in the individual cooling channels differently heated coolant layers are created because of differing flow conditons, the temperature differences are equalized when the coolant is led off in the one single reflux tube; thus the coolant is mixed in the reflux tube, and the coolant streams leading upward from the next distributor conduit section via the next group of cooling channels once again have a completely uniform temperature.

Finally a further advantage of the invention consists in that, due to the alternating arrangement of cooling channel groups having a smaller cross-section, and always one reflux tube having a wider cross-section, no uniform outer surface is present. When slag boils over and flows off over the converter hood, the slag cannot cake, because the surface is not even.

Figure 2:
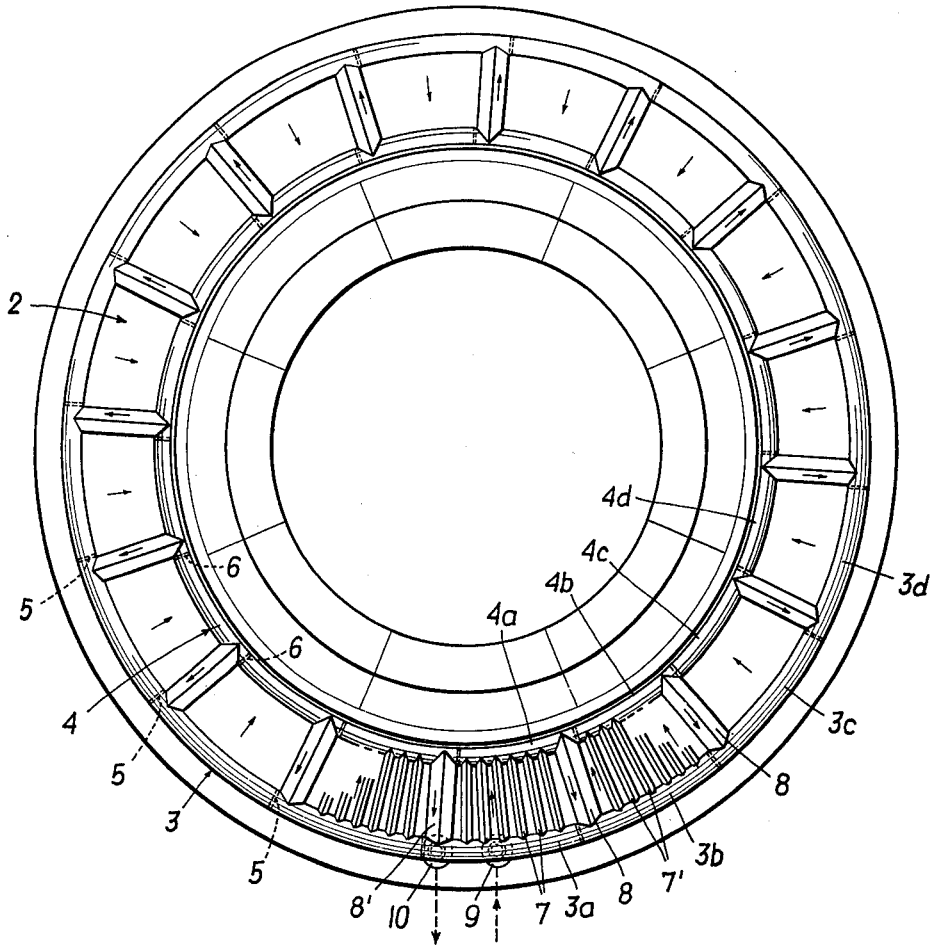

The invention shall now be described by way of an example and with reference to the accompanying drawings, wherein FIG. 1 is a side view, and FIG. 2 is a schematic top view onto the converter hood.

On the jacket face of the converter hood 2 connected to the converter 1, annular conduits are provided at a distance from one another and extending horizontally, i.e. the lower distributor conduit 3 and the upper collector conduit 4. These annular conduits are sectionally partitioned by parting walls 5 and 6, respectively, so that distributor conduit sections 3*a*, 3*b*, 3*c* . . . and collector conduit sections 4*a*, 4*b*, 4*c* . . . follow upon one another. Between the two annular conduits 3 and 4, a plurality of cooling channels 7 are arranged in groups, which also consist of groove-shaped sections or corner irons and are welded to the jacket face of the converter hood. To each one of these groups 7 of cooling channels, one single reflux tube 8 is allocated which also consists of a groove-shaped section, which is welded to the jacket face of the hood and has an accordingly wider cross-section. The reflux tubes are arranged in a manner that always one upper collector conduit section 4*a* is connected with the following lower distributor section 3*b* via a reflux tube 8. One lower distributor conduit section 3*a* is connected to the coolant inlet 9, and the last reflux tube 8' is connected to the coolant outlet 10, advantageously both connections going through the carrying trunnions of the converter, which is not shown in detail.

The device functions in such a way that the coolant, entering at 9, comes into the first distributor conduit section 3*a*, and from there rises through the channels of the group 7 to the converter mouth, is collected in the first collector conduit section 4*a*, is led via the first reflux tube 8 to the distributor conduit section 3*b*, from where it rises with an equalized temperature through the next cooling channel group 7′ to the converter mouth and is collected in section 4*b*, whereupon it is led via the next reflux tube into the distributor conduit section 3*c* and so on, and after completing the full circuit, it is led off via the outflow conduit 10.

What we claim is:

1. A converter with a converter hood, comprising a plurality of cooling channels arranged in groups and extending over the periphery of the converter hood substantially in generatrix direction for receiving coolant to flow upwardly therethrough, coolant passage means extending horizontally over the periphery of the converter hood and connected to the cooling channels, which coolant passage means comprises lower coolant distributor conduit sections and upper coolant collector conduit sections, coolant supply and drain means connected to the coolant passage means, coolant reflux tubes so arranged that one single reflux tube coacts with a group of cooling channels each and connects one upper coolant collector conduit section with the respective lower coolant distributor conduit section following thereupon.

2. A converter as set forth in claim 1 with two carrying trunnions, wherein the coolant supply and drain means run through at least one of the carrying trunnions.

3. A converter as set forth in claim 1, wherein the cross section of each of the cooling channels in a group is smaller than the cross section of the respective single coolant reflux tube coacting with the group to create an uneven converter hood surface.

* * * * *